US010947784B2

(12) United States Patent
Zalluhoglu et al.

(10) Patent No.: US 10,947,784 B2
(45) Date of Patent: Mar. 16, 2021

(54) SLIDING MODE CONTROL TECHNIQUES FOR STEERABLE SYSTEMS

(71) Applicant: HALLIBURTON ENERGY SERVICES, INC., Houston, TX (US)

(72) Inventors: Umut Zalluhoglu, Humble, TX (US); Yiming Zhao, Katy, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 68 days.

(21) Appl. No.: 16/474,944

(22) PCT Filed: Dec. 29, 2017

(86) PCT No.: PCT/US2017/069048
§ 371 (c)(1),
(2) Date: Jun. 28, 2019

(87) PCT Pub. No.: WO2018/144169
PCT Pub. Date: Aug. 9, 2018

(65) Prior Publication Data

US 2019/0345771 A1 Nov. 14, 2019

Related U.S. Application Data

(60) Provisional application No. 62/452,917, filed on Jan. 31, 2017.

(51) Int. Cl.
*E21B 7/10* (2006.01)
*E21B 7/06* (2006.01)
(Continued)

(52) U.S. Cl.
CPC ..... *E21B 7/10* (2013.01); *E21B 7/06* (2013.01); *E21B 41/0092* (2013.01);
(Continued)

(58) Field of Classification Search
CPC ..... E21B 7/06; E21B 7/10; E21B 41/0092; E21B 44/00
See application file for complete search history.

(56) References Cited

U.S. PATENT DOCUMENTS 9,022,141 B2 5/2015 Panchal et al.
9,157,309 B1 * 10/2015 Benson ..... E21B 7/10
(Continued)

OTHER PUBLICATIONS

International Search Report and Written Opinion; PCT Application No. PCT/US2017/069048; dated Apr. 20, 2018.
(Continued)

*Primary Examiner* — Shane Bomar
(74) *Attorney, Agent, or Firm* — Polsinelli PC

(57) ABSTRACT

A method for directional drilling including defining, by a sliding mode controller, a sliding hypersurface for reducing a trajectory error in one or more error dimensions; determining a current trajectory error between a current trajectory of a directional drilling tool and a reference trajectory for a curved path, the current trajectory error corresponding to a current error position in the one or more error dimensions; calculating a sliding mode vector originating from the current error position and substantially conforming to the sliding hypersurface in the one or more error dimensions; determining a feedback control input for the directional drilling tool based on the sliding mode vector; instructing the directional drilling tool to generate a wellbore path according to the feedback control input; and updating the current trajectory error based on either a change in position or a change in attitude of the directional drilling tool.

20 Claims, 10 Drawing Sheets

(51) Int. Cl.

| | |
|---|---|
| ***E21B 41/00*** | (2006.01) |
| ***E21B 44/00*** | (2006.01) |
| *E21B 47/022* | (2012.01) |
| *E21B 47/12* | (2012.01) |

(52) U.S. Cl.
CPC ..... *E21B 44/005* (2013.01); *E21B 47/022* (2013.01); *E21B 47/12* (2013.01)

(56) References Cited

U.S. PATENT DOCUMENTS

| | | | | |
|---|---|---|---|---|
| 9,404,355 | B2 | 8/2016 | Bayliss | |
| 9,790,780 | B2 * | 10/2017 | Dykstra | E21B 47/09 |
| 9,945,222 | B2 * | 4/2018 | Sugiura | E21B 44/005 |
| 2010/0175922 | A1 | 7/2010 | Ignova et al. | |
| 2013/0048383 | A1 * | 2/2013 | Panchal | E21B 44/00 175/61 |
| 2013/0161096 | A1 * | 6/2013 | Benson | E21B 7/04 175/26 |
| 2014/0196950 | A1 | 7/2014 | Bayliss | |
| 2014/0305704 | A1 | 10/2014 | Benson et al. | |
| 2016/0312598 | A1 | 10/2016 | Samuel et al. | |
| 2017/0328192 | A1 * | 11/2017 | Wessling | E21B 47/06 |
| 2019/0284908 | A1 * | 9/2019 | Dykstra | E21B 44/00 |
| 2019/0284921 | A1 * | 9/2019 | Xue | G06Q 30/0283 |

OTHER PUBLICATIONS

Jayakody, Hiranya et al. "Sliding Mode Based Position and Attitude Controller for Vectored Thrust Aerial Vehicle", Proceedings of Australasian Conference on Robotics and Automation; University of South Wales, Sydney Australia, Dec. 2, 2013.

* cited by examiner

SLIDING MODE CONTROL TECHNIQUES FOR STEERABLE SYSTEMS

CROSS-REFERENCE TO RELATED APPLICATIONS

This application is a national stage entry of PCT/US2017/069048 filed Dec. 29, 2017, which claims to the benefit of U.S. Provisional Patent Application No. 62/452,917, filed Jan. 31, 2017, the contents of each of the aforementioned are hereby expressly incorporated by reference in their entirety. The present application claims the benefit of U.S. Provisional Application No. 62/452,917, filed Jan. 31, 2017, which is hereby incorporated by reference in its entirety.

TECHNICAL FIELD

The present technology generally pertains to directional drilling within subterranean earth formations, and more specifically, to sliding mode feedback controls for path tracking and error correction in directional drilling.

BACKGROUND

Directional drilling, or controlled steering, is commonly used to guide drilling tools in the oil, water, and gas industries to reach resources that are not located directly below a wellhead. Directional drilling particularly provides access to reservoirs where vertical access is difficult if not impossible. In general, directional drilling refers to steering a drilling tool according to a predefined well path plan, having target coordinates and drilling constraints, created by a multidisciplinary team (e.g., reservoir engineers, drilling engineers, geo-steerers, geologists, etc.) to optimize resource collection/discovery.

As the future of directional drilling moves toward exploiting complex reservoirs and difficult to reach resources, it becomes increasingly important for the drilling tool to follow these predefined path plans as closely as possible. Deviations from such pre-defined path plans may result in a waste of resources, damage the drilling tools, or even undermine the stability of earth formations surrounding a reservoir. Path tracking along the predefined path plans often presents new challenges due, in part, physical and operational constraints of the drilling tools, characteristics of rock formations, complex well geometries, and the like.

BRIEF DESCRIPTION OF THE DRAWINGS

The embodiments herein may be better understood by referring to the following description in conjunction with the accompanying drawings in which like reference numerals indicate analogous, identical, or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
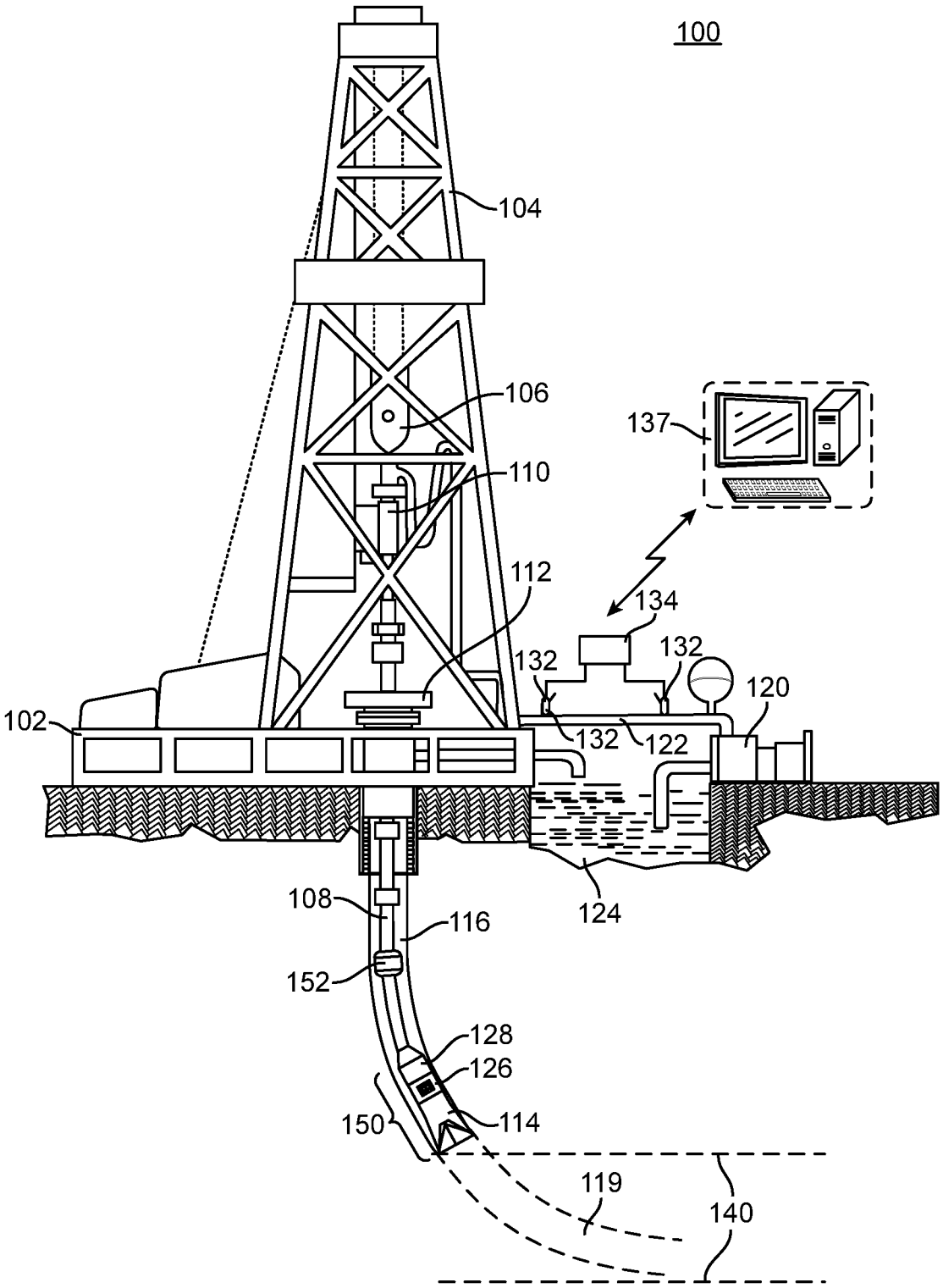
FIG. 1 is a schematic diagram of a directional drilling environment, showing measurement while drilling (MWD) operations.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

As used herein, the term "coupled" is defined as connected, whether directly or indirectly through intervening components, and is not necessarily limited to physical connections. The term "substantially" is defined to be essentially conforming to the particular dimension, shape or other word that substantially modifies, such that the component need not be exact. For example, substantially rectangular means that the object in question resembles a rectangle, but can have one or more deviations from a true rectangle. The "position" of an object can refer to a placement of the object, location of the object, plane of the object, direction of the object, distance of the object, azimuth of the object, axis of the object, inclination of the object, horizontal position of the object, vertical position of the object, and so forth. Moreover, the "position" of an object can refer to the absolute or exact position of the object, the measured or estimated position of the object, and/or the relative position of the object to another object.

The disclosure generally relates to drilling a wellbore path that substantially conforms to a planned well path. In particular, this disclosure describes directional drilling tools that employ a sliding mode controller to correct errors or discrepancies between a target trajectory for a predetermined wellbore path (also referred to herein as a "reference trajectory") and an actual trajectory of the directional drilling tool. For example, the sliding mode controller can detect an error between target trajectory and an actual trajectory, evaluate the differences in trajectory, create an updated path configured to converge the actual trajectory with the predetermined wellbore path, and provide feedback to the directional drilling tool in the form of an updated vector configured to adjust the trajectory of the tool.

Notably, the directional drilling tool, device, system, etc., can include a controller communicatively coupled with a steering assembly that can direct a drill bit as it creates a borehole along a desired path (i.e., trajectory). Further, the steering assembly can include, for example, a rotary steerable system ("RSS") that can change direction of the drilling string via a control input (such as a sliding mode vector), provided by the sliding mode controller. However, it is also appreciated that these techniques may be employed by other known directional drilling tools.

FIG. 1 is a schematic diagram of a directional drilling environment, particularly showing a measurement-while-drilling (MWD) system 100, in which the presently disclosed techniques may be deployed. As depicted, the MWD system 100 includes a drilling platform 102 having a derrick 104 and a hoist 106 to raise and lower a drill string 108. Hoist 106 suspends a top drive 110 suitable for rotating drill string 108 and lowering drill string 108 through a well head 112. Notably, drill string 108 may include sensors or other instrumentation for detecting and logging nearby characteristics and conditions of the wellbore and surrounding earth formation.

In operation, top drive 110 supports and rotates drill string 108 as it is lowered through well head 112. In this fashion, drill string 108 (and/or a downhole motor) rotate a drill bill 114 coupled with a lower end of drill string 108 to create a borehole 116 through various formations. A pump 120 can circulate drilling fluid through a supply pipe 122 to top drive 110, down through an interior of drill string 108, through orifices in drill bit 114, back to the surface via an annulus around drill string 108, and into a retention pit 124. The drilling fluid can transport cuttings from wellbore 116 into pit 124 and helps maintain wellbore integrity. Various materials can be used for drilling fluid, including oil-based fluids and water-based fluids.

As shown, drill bit 114 forms part of a bottom hole assembly 150, which further includes drill collars (e.g., thick-walled steel pipe) that provide weight and rigidity to aid drilling processes. Detection tools 126 and a telemetry sub 128 are coupled to or integrated with one or more drilling collars.

Detection tools 126 may gather MWD survey data or other data and may include various types of electronic sensors, transmitters, receivers, hardware, software, and/or additional interface circuitry for generating, transmitting, and detecting signals (e.g., sonic waves, etc.), storing information (e.g., log data), communicating with additional equipment (e.g., surface equipment, processors, memory, clocks input/output circuitry, etc.), and the like. In particular, detection tools 126 can measure data such as position, orientation, weight-on-bit, strains, movements, borehole diameter, resistivity, drilling tool orientation, which may be specified in terms of a tool face angle (rotational orientation), and inclination angle (the slope), and compass direction, each of which can be derived from measurements by sensors (e.g., magnetometers, inclinometers, and/or accelerometers, though other sensor types such as gyroscopes, etc.).

Telemetry sub 128 communicates with detection tools 126 and transmits telemetry data to surface equipment (e.g., via mud pulse telemetry). For example, telemetry sub 128 can include a transmitter to modulate resistance of drilling fluid flow thereby generating pressure pulses that propagate along the fluid stream at the speed of sound to the surface. One or more pressure transducers 132 operatively convert the pressure pulses into electrical signal(s) for a signal digitizer 134. It is appreciated other forms of telemetry such as acoustic, electromagnetic, telemetry via wired drill pipe, and the like may also be used to communicate signals between downhole drilling tools and signal digitizer 134. Further, it is appreciated telemetry sub 128 can store detected and logged data for later retrieval at the surface when bottom hole assembly 150 is recovered.

Digitizer 134 converts the pressure pulses into a digital signal and sends the digital signal over a communication link to a computing system 137 or some other form of a data processing device. In at least some embodiments, computer system 137 includes processing units to analyze collected data and/or perform other operations by executing software or instructions obtained from a local or remote non-transitory computer-readable medium. As shown, computer system 137 includes input device(s) (e.g., a keyboard, mouse, touchpad, etc.) as well as output device(s) (e.g., monitors, printers, etc.). These input/output devices provide a user interface that enables an operator to interact and communicate with the borehole assembly 150, surface/downhole directional drilling components, and/or software executed by computer system 137.

For example, computer system 137 enables an operator to select or program directional drilling options, review or adjust types of data collected, modify values derived from the collected data (e.g., measured bit position, estimated bit position, bit force, bit force disturbance, rock mechanics, etc.), adjust borehole assembly dynamics model parameters, generate drilling status charts, waypoints, a desired borehole path, an estimated borehole path, and/or to perform other tasks. In at least some embodiments, the directional drilling performed by borehole assembly 150 is based on a surface and/or downhole feedback loops, as discussed in greater detail below.

MWD system 100 also includes a controller 152 that instructs or steers bottom hole assembly 150 as drill bit 114 extends wellbore 116 along a desired path 119 (e.g., within one or more boundaries 140). The bottom hole assembly includes a steering system, such as steering vanes, bent stub, or rotary steerable system (RSS), thereby together with the drill bit 114 form a directional drilling tool. Controller 152 includes processors, sensors, and other hardware/software and which may communicate to components of the steering system. For instance with a RSS, the controller 152 applies a force to flex or bend a drilling shaft coupled to bottom hole assembly 150, or by steering pads on the outside of a non-rotating housing, imparts an angular deviation to a current the direction traversed by drill bit 114. Controller 152 can communicate real-time data with one or more components of bottom hole assembly 150 and/or surface equipment. In this fashion, controller 152 can analyze real-time data and generate steering signals according to, for example, the feedback control techniques discussed herein. While controller 152 is shown and described as a single component that operates for a particular type of directional drilling, it is appreciated controller 152 may include any number of sub-components that collectively communicate and operate to perform the above discussed functions. Controller 152 represents an example component, which may further include various other types of steering mechanisms as well—e.g., steering vanes, a bent sub, and the like. It is further appreciated by those skilled in the art, the environment shown in FIG. 1 is provided for purposes of discussion only, not for purposes of limitation. The detection tools, drilling devices, and sliding mode control techniques discussed herein may be suitable in any number of drilling environments.

Figure 2:
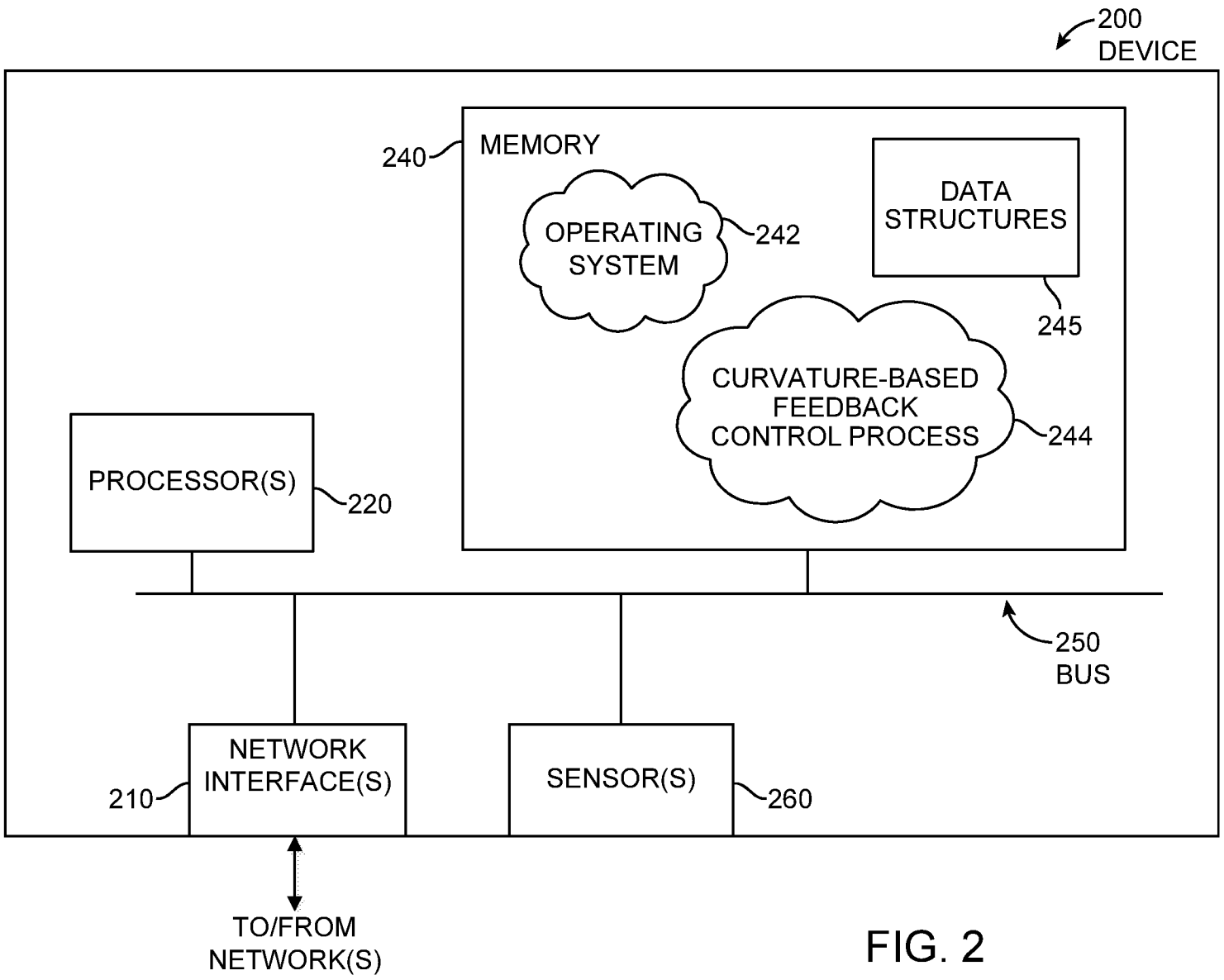
FIG. 2 is a schematic diagram of a directional drilling tool.

FIG. 2 is a block diagram of an exemplary device 200, which can include controller 152 (or components thereof). Device 200 is particularly configured to perform control techniques discussed herein and communicate signals that steer or direct the drilling tool along a curved well path.

As shown, device 200 includes hardware and software components such as network interfaces 210, at least one processor 220, sensors 260 and a memory 240 interconnected by a system bus 250. Network interface(s) 210 include mechanical, electrical, and signaling circuitry for communicating data over communication links, which may include wired or wireless communication links. Network interfaces 210 are configured to transmit and/or receive data using a variety of different communication protocols, as will be understood by those skilled in the art. For example, device 200 can use network interface 210 to communicate with one or more of the above-discussed borehole assembly 150 components and/or communicate with remote devices/systems such as computer system 137.

Processor 220 represents a digital signal processor (e.g., a microprocessor, a microcontroller, or a fixed-logic processor, etc.) configured to execute instructions or logic to perform tasks in a wellbore environment. Processor 220 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 220 typically operates in conjunction with shared or dedicated hardware, including but not limited to, hardware capable of executing software and hardware. For example, processor 220 may include elements or logic adapted to execute software programs and manipulate data structures 245, which may reside in memory 240.

Sensors 260 typically operate in conjunction with processor 220 to perform wellbore measurements, and can include special-purpose processors, detectors, transmitters, receivers, and the like. In this fashion, sensors 260 may include hardware/software for generating, transmitting, receiving, detecting, logging, and/or sampling magnetic fields, seismic activity, and/or acoustic waves.

Memory 240 comprises a plurality of storage locations that are addressable by processor 220 for storing software programs and data structures 245 associated with the embodiments described herein. An operating system 242, portions of which are typically resident in memory 240 and executed by processor 220, functionally organizes the device by, inter alia, invoking operations in support of software processes and/or services executing on device 200. These software processes and/or services may comprise an illustrative "sliding mode control" process/service 244, as described herein. Note that while sliding mode control process/service 244 is shown in centralized memory 240, some embodiments provide for these processes/services to be operated in a distributed computing network.

It will be apparent to those skilled in the art that other processor and memory types, including various computer-readable media, may be used to store and execute program instructions pertaining to the borehole evaluation techniques described herein. Also, while the description illustrates various processes, it is expressly contemplated that various processes may be embodied as modules configured to operate in accordance with the techniques herein (e.g., according to the functionality of a similar process). Further, while some processes or functions may be described separately, those skilled in the art will appreciate the processes and/or functions described herein may be performed as part of a single process. In addition, the disclosed processes and/or corresponding modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 220 or computer readable medium encoded with instructions for execution by processor 220 that, when executed by the processor, are operable to cause the processor to perform the functions described herein.

Figure 3:
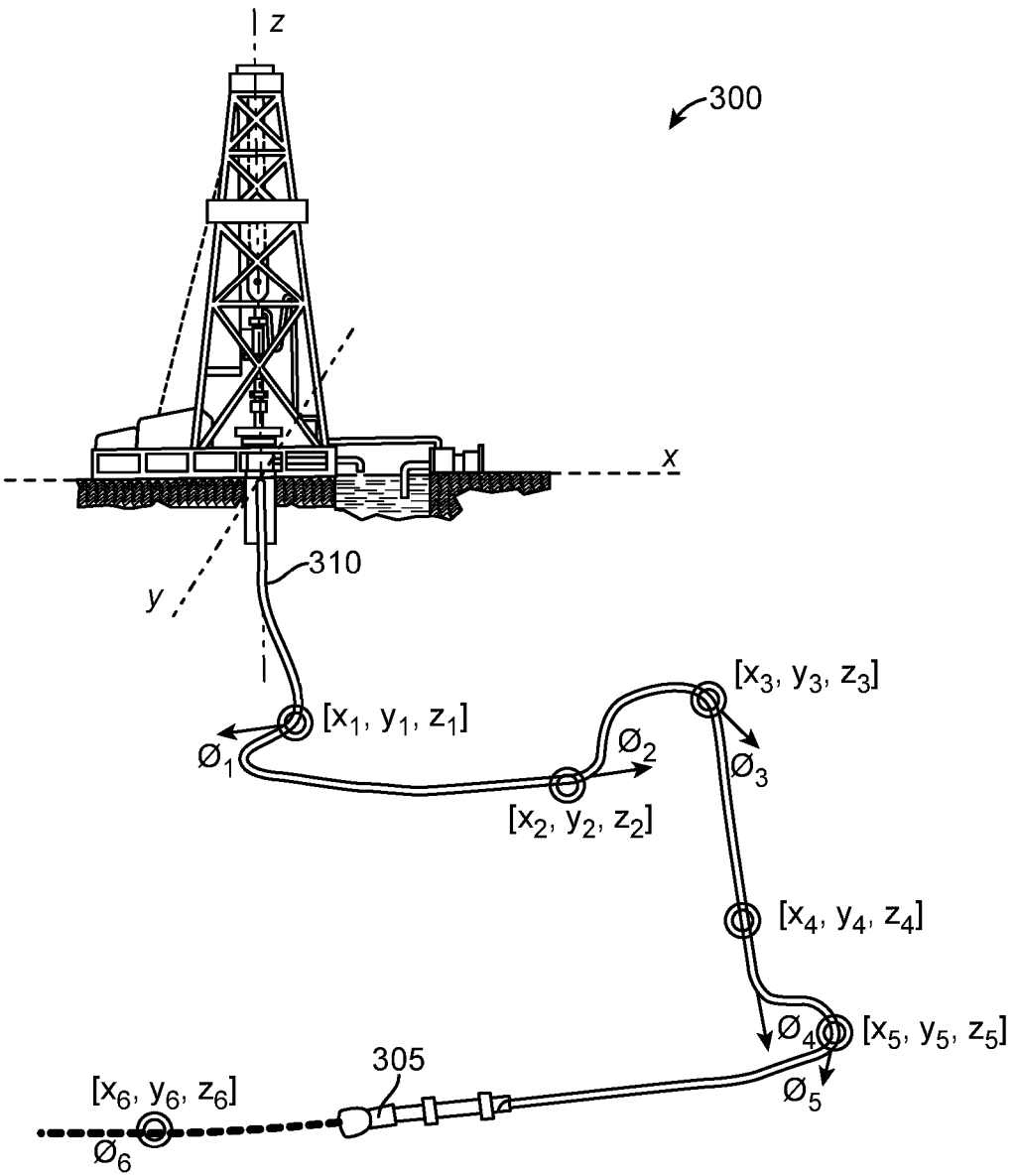
FIG. 3 is a schematic diagram of a three-dimensional (3D) wellbore environment, showing a directional drilling tool following a well path defined by a collection of waypoints.

FIG. 3 is a schematic diagram of a 3D wellbore environment 300, showing a drilling tool 305 as it creates a wellbore path that substantially follows a predetermined well path 310. Predetermined wellbore path 310 can be described as three-dimensional (3D) path in an earth formation and defined by a collection of waypoints. Generally, each waypoint can correspond to a position in the 3D space, and possibly, higher order information about the path at the specified location. For example, in this context, a 3D waypoint may take the form of: $x_i$, $y_i$, $z_i$, $x'_i$, $y'_i$, $z'_i$, $x''_i$, $y''_i$, $z''_i$, . . . and so on. Where $x'_i$, $y'_i$, $z'_i$ represent first derivatives of the predetermined wellbore path with respect to a path length coordinate associated with the predetermined wellbore path, and $x''_i$, $y''_i$, $z''_i$ represent second derivatives of the predetermined wellbore path with respect to the path length coordinate associated with the predetermined wellbore path. Notably, attitude information, which can include inclination and azimuth, is typically defined as part of the predetermined wellbore path, or it may also be inferred based on known interpolation schemes for smoothly interpolating multiple waypoints. In addition, $x''_i$, $y''_i$, $z''_i$ may be optionally included as part of the definition of a waypoint.

For example, as shown, predetermined well path 310 is defined by a collection of waypoints, labeled as $[x_1, y_1, z_1]$; $[x_2, y_2, z_2]$; . . . $[x_6, y_6, z_6]$. Notably, each waypoint may include higher order information (e.g., derivatives) such as a steering angle or attitude angle $\phi$ (e.g., labeled as "$\phi_1$" through "$\phi_6$"). Wellbore environment 300 represents an ideal environment where drilling tool 305 creates a stable wellbore path that accurately tracks predetermined well path 310. In real-world environments, however, the wellbore path may be subject to various instabilities, disturbances, noise, faults, and the like, which may require path correction or adjustment in order to minimize path divergence or deviation.

Various control techniques may be employed to adjust and conform a current wellbore path of a drilling tool to a predetermined or planned well path. For example, one type of control technique includes an attitude control, which attempts to control a drilling tool's attitude (inclination and azimuth) to minimize wellbore path divergence from the predetermined wellbore path. However, when a predetermined wellbore path is described by a tool attitude (including inclination and azimuth), and only attitude control is applied for and path correction/convergence on tool attitude relative to the predetermined wellbore path, the actual drilled wellbore path can deviate considerably from the planed well path.

Figure 4A:
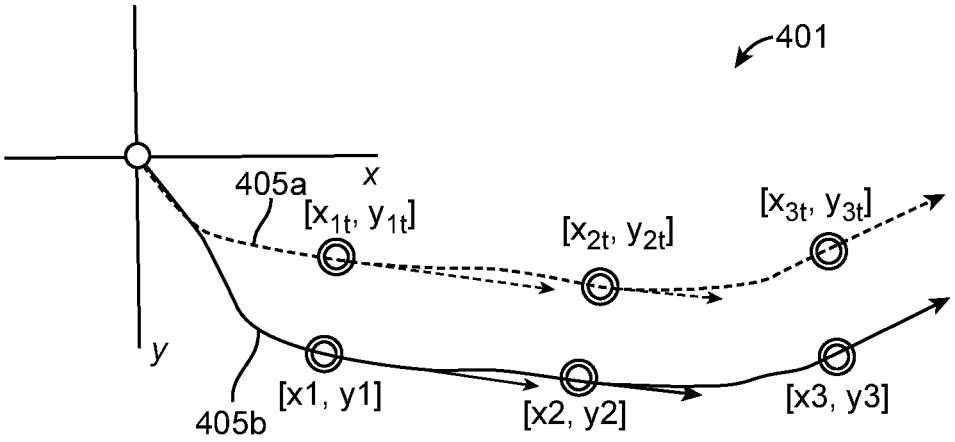
FIG. 4A is a graph showing two-dimensional (2D) wellbore path divergences for directional drilling using attitude azimuth correction.
Figure 4B:
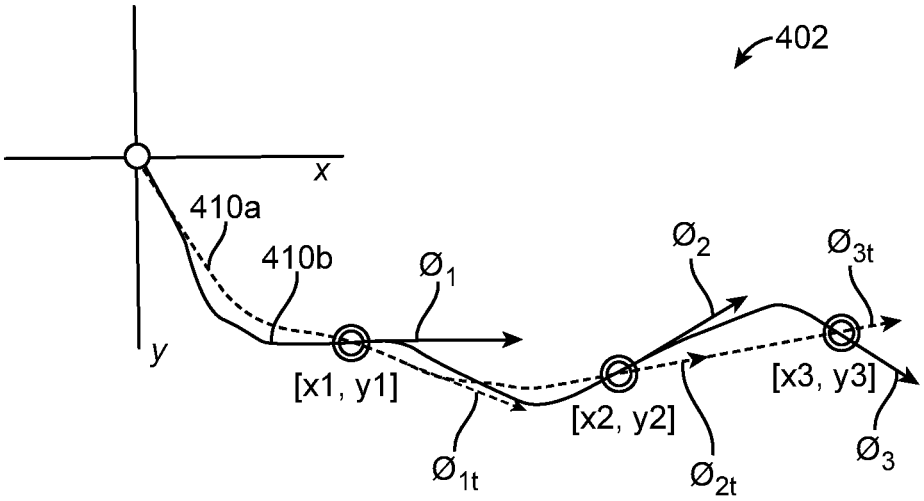
FIG. 4B is a graph showing 2D wellbore path divergences for directional drilling using attitude position correction.

FIGS. 4A and 4B provide graphs 401 and 402, respectively, showing well path divergences caused by attitude azimuth correction (graph 401) and attitude inclination or position correction (graph 402). Here, graph 401 illustrates an intended or target well path 405*a* (dashed line), defined by "target" waypoints $[x_{1t}, y_{1t}]$ $[x_{2t}, y_{2t}]$, and $[x_{3t}, y_{3t}]$, and an actual wellbore path 405*b* (solid line) created or traversed by the drilling tool, defined by actual waypoints $[x_1, y_1]$, $[x_2, y_2]$, and $[x_3, y_3]$. In operation, the drilling tool may include a controller (e.g., a hardware/software) that performs path tracking and steers the drilling tool through waypoints for an intended well path as it creates an actual wellbore path.

As shown, in FIG. 4A, the controller applies attitude azimuth correction or attitude hold that matches a current attitude for a position on actual wellbore path 405*b* to a target attitude (inclination) for a corresponding position on the intended well path 405*a*. In other words, the controller employs an attitude hold that directs the drill tool to actual positions/actual waypoints so that the drilling tool has the same attitude (inclination) as the corresponding target waypoint (e.g., the inclination of drilling tool at waypoint $[x_1, y_1]$ is the same as the target inclination at waypoint $[x_{1t}, y_{1t}]$). Although such attitude hold control ensures attitude convergence between the actual wellbore path and the intended well path, deviations may be present or even increase depending on distances traversed and a complexity of the predetermined wellbore path.

In FIG. 4B, graph 402 illustrates deviations between an intended well path 410*a* (dashed line) and an actual wellbore path 410*b* (solid line) when the controller applies position hold controls. Here, both well path 410*a* and wellbore path 410*b* are defined by the same waypoints $[x_1, y_1]$, $[x_2, y_2]$, and $[x_3, y_3]$. In operation, the controller steers the drilling tool along the same waypoints of both paths and matches the target position for each target waypoint. As shown, actual well path 410*b* represents a position hold control, which directs the drill tool to traverse the target waypoints. While such position hold controls ensure wellbore path 410*b* substantially traverses each target waypoint, such position hold controls may create oscillating behavior and divergences between intended well path 410*a* and wellbore path 410*b*. This oscillation may be caused, in part, by differences between an actual steering angles (labeled as "$\phi_1$" through "$\phi_3$") of the drill tool and target steering angles (labeled as "$\phi_{1t}$" through "$\phi_{6t}$") at each waypoint.

Figure 5:
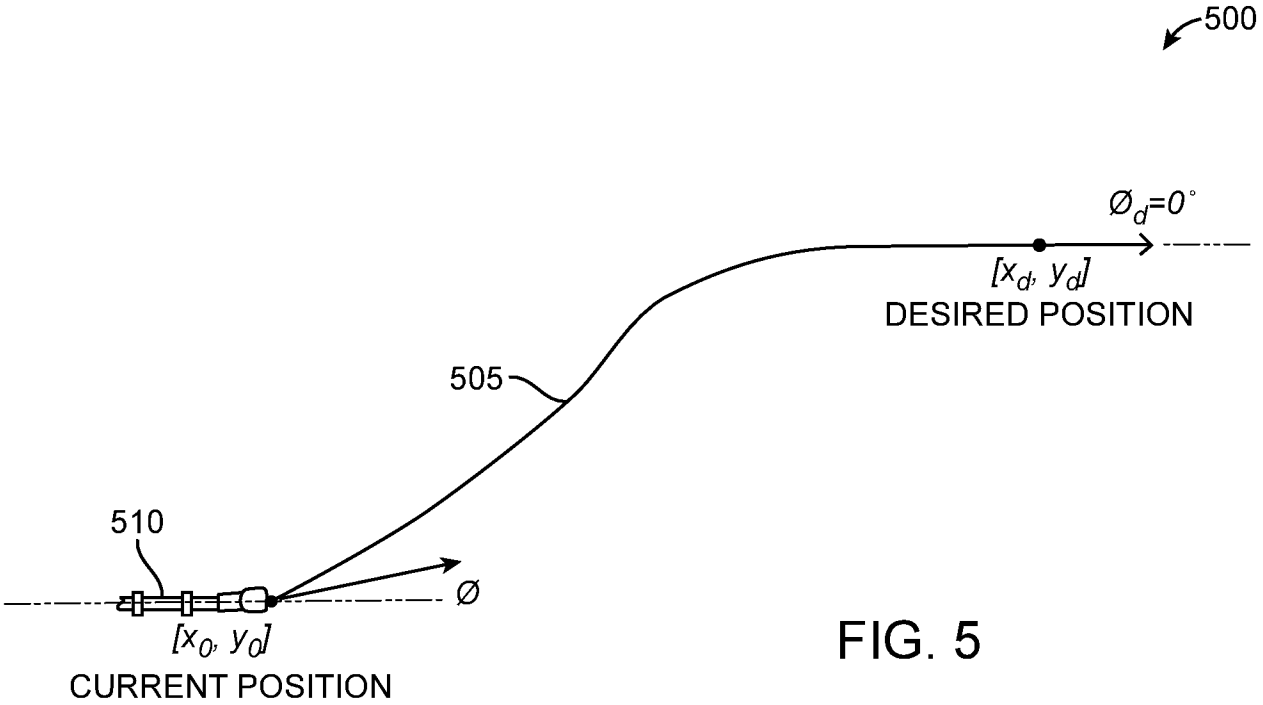
FIG. 5 is a graph showing wellbore path convergence for directional drilling using attitude position correction.

The sliding mode control techniques disclosed herein mitigate and minimize path divergences, as shown in FIGS. 4A and 4B, and provide simultaneous convergence for position and attitude with respect to a predetermined wellbore path. For example, a wellbore path generated by a drilling tool can be described according to its curvature. The sliding mode control techniques continuously monitor trajectory errors and adjust curvature-based control inputs to steer the drilling tool substantially along or proximate to a predetermined well path. These curvature-based control inputs can simultaneously adjust both position and attitude of the drilling tool in a single control loop and can be represented by a curved convergence path, as shown in FIG. 5.

Generally, with respect to a curvature of a wellbore path (and/or a curved convergence path), a 3D well path of the drilling tool can be projected into two perpendicular planes and represented by a unique curve in each plane. For example, the following kinematic equation can represent an arbitrary evolution of wellbore in a 2D plane with Cartesian coordinates (x and y), where s is a path length coordinate (e.g., a curvilinear coordinate defined along the wellbore path), $\phi$ is a steering angle, and $\kappa$ is the curvature. When x and y define a vertical plane, $\phi$ may be interpreted as inclination when $\phi \in [0, \pi]$. Notably, in equations 1-3, $\phi \in (-\infty, \infty)$ (and equivalents thereof) can generate an arbitrary path with continuous first derivatives in an x-y plane.

$$x'(s)=\cos(\phi(s)) \tag{1}$$

$$y'(s)=\sin(\phi(s)) \tag{2}$$

$$\phi'(s)=\kappa(s) \tag{3}$$

In this fashion, equations 1-3 can uniquely identify a curvature $\kappa(s)$ for a curved wellbore path or a curved convergence path as a function of a current position and attitude. Preferably, a drilling tool controller (e.g., controller 152, etc.) continuously computes and adjusts curvature values $\kappa(s)$ in a state feedback control law, and operatively steers the drilling tool based on the curvature values as it generates a curved wellbore path (e.g., by adjusting an appropriate amount of RSS force and bending, etc.).

For example, such a state feedback control law may take the form of equations 4 and 5:

$$\kappa(s)=SFB(x(s),y(s),x'(s),y'(s),x_d,y_d,x'_d,y'_d) \tag{4}$$

$$\kappa(s)=SFB(x(s),y(s),x'(s),y'(s),x_d,y_d,x'_d,y'_d,x''_d,y''_d, \ldots) \tag{5}$$

Where the curvature value $\kappa(s)$ represents a curvature of a curved path between a current location and a target waypoint that satisfies both position and slope constraints.

FIG. 5 illustrates a graph 500, showing a drilling tool 505 that employs the above state feedback control law to determine a curved convergence path 505. Curved convergence path 505 originates at a current position of drilling tool 505 $[x_0, y_0]$ and converges toward a desired position $[x_d, y_d]$ while simultaneously providing position and attitude convergence such that drill tool 510 traverses desired position $[x_d, y_d]$ at a desired orientation or attitude $\phi_d$. Notably, a current orientation of drill tool 510 at current position $[x_0, y_0]$ is represented $\phi$, and derivatives of x and y positions are specified according to Equation 6:

$$x'(0)=\cos\phi,\ y'(0)=\sin\phi \tag{6}$$

Where a desired location and attitude (waypoint) are represented by $x_d$, $y_d$, $x'_d$, $y'_d$ Curved convergence path 505 intersects current position $[x_0, y_0]$ (tangent to current attitude $\phi$) and the desired position $[x_d, y_d]$ at (at the desired orientation $\phi_d$). For purposes of illustration and discussion herein, assume the tangent direction of the path at $[x_d, y_d]$ is parallel to the x axis (i.e., $\phi_d=0$). However, for non-parallel tangents, another set of $\tilde{x}$-$\tilde{y}$ coordinates may be determined by rotating the original x-y system to ensure a parallel relation. The coordinate transform may be performed from x-y to $\tilde{x}$-$\tilde{y}$ to establish equivalent boundary conditions at current and target positions in the $\tilde{x}$-$\tilde{y}$ domain, as is appreciated by those skilled in the art.

In certain instances, when x is very close proximity or distance to $x_d$ and y and y' has not converged to the desired value yet, a large or steep curvature value is needed for path convergence with respect to both position and attitude. Preferably, however, when x is sufficiently close to $x_d$ (e.g., x is within a threshold distance from $x_d$) the current target waypoint may be assigned to a "next" target waypoint on the planned path. For example, the next or subsequent waypoint on the planned path may be selected when x (a current position) is within a threshold distance of $x_d$ and/or a curvature value for the drilling tool to pass proximate (or through) $x_d$ is above/below a threshold tolerance, and the like. Alternatively (or in addition), the "next" target waypoint may continuously move along the planned path as the drill tool moves forward to avoid any steep curvatures and minimize potential oscillations.

With respect to three dimension (3D) coordinates, the waypoint can be selected based on Equations 7 and 8:

$$s_c=\min_s[(x_c-x_p(s))^2+(y_c-y_p(s))^2+(z_c-z_p(s))^2]^{1/2} \quad (7)$$

$$[x_p(s_c+\tau),y_p(s_c+\tau),z_p(s_c+\tau)] \quad (8)$$

Where $X_c=(x_c, y_c, z_c)$ is the current position, and $[x_p(s), y_p(s), z_p(s)]$ defines the planned path, s is depth, and $s_c$ denotes the depth at which the position of the well plan is closest to the current position.

Notably, equation 8 defines a target position $[x_p, y_p, z_p]$ and derivatives of the target position correspond to a target attitude. In operation, if a curvature value for a curved convergence path (between the current position and the target position) is larger than a threshold, $\tau$ is increased. Moreover, equations 7 and 8 are typically calculated in an iterative fashion and as part of the state feedback control law.

Collectively, the above discussed state feedback control law and associated curvature calculations describe and solve for curvature values of a curved convergence path that satisfies position constraint and slope constraints between a current location and a target waypoint. In operation, drilling tool 510 typically includes a controller (e.g., controller 152) that executes the state feedback control law to continuously determine curvature values for the curved convergence path and provide control inputs (e.g., curvature-based inputs) based on the curvature values to a force or bending controller that steers drilling tool 510. For example, the controller, when executing the state feedback control law, is operable to track its current position ($[x_0, y_0]$) and its current attitude ($\phi$), and determine a curvature value ($\kappa(s)$) for a curved convergence path (convergence path 505) that intersects the current position (tangent the current attitude), and a curvilinear or target position ($[x_d, y_d]$) on or substantially proximate to a target wellbore path (tangent to a target attitude ($\phi_d$)). As shown, $\phi_d$ at the curvilinear position is parallel to the x axis (i.e., $\phi_d=0$). The controller provides the curvature value (and/or a curvature control input based on the curvature value) to force/bending hardware in drilling tool 505 to generate the curved convergence. With respect to feedback, the controller continuously receives sensor data regarding its current position/attitude and re-calculates the curvature values to adjust the curved convergence path.

In addition, in some embodiments, the controller may also update the curvilinear position (e.g., $[x_d, y_d]$) on the target well path to avoid oscillating behavior. For example, drilling tool 510 may update the curvilinear position based on a threshold distance or threshold proximity between drilling tool 510 and the curvilinear position in order to avoid steep curvatures that violate drilling constraints (e.g., dogleg severity constraints (DLS), etc.). Further, the target curvilinear position may also be continuously updated and assigned to a new position on or substantially proximate to the well path (e.g., when drilling tool 510 updates its current position). This new position may include a "next" waypoint position and/or it may include any number of other positions on the well path. It is also appreciated that convergence or intersection between the curved convergence path and the target well path may not be possible (or even desired) in certain instances. In such instances, the curved convergence path may represent a "best" path having positions that are substantially close or proximate to one or more positions that define the target well path and at a target attitude substantially similar a well path attitude for corresponding positions.

It is appreciated the view shown in FIG. 5 is provided for purposes of illustration and discussion, not limitation. While FIG. 5 illustrates one embodiment of a state feedback control law and a resultant curved convergence path 505, any number of state feedback control law and curved paths calculations may be used as appropriate. For example, as discussed in greater detail below, the general principles to determine curvature values for a curved convergence path may be readily incorporated into sliding mode control logic.

Sliding mode control logic generally refers to a nonlinear feedback control techniques that drives a system state onto a particular surface in state space—e.g., a "sliding surface" or a "sliding hypersurface" and maintains or constrains the system state on (or in close proximity to) the particular surface.

Figure 6:
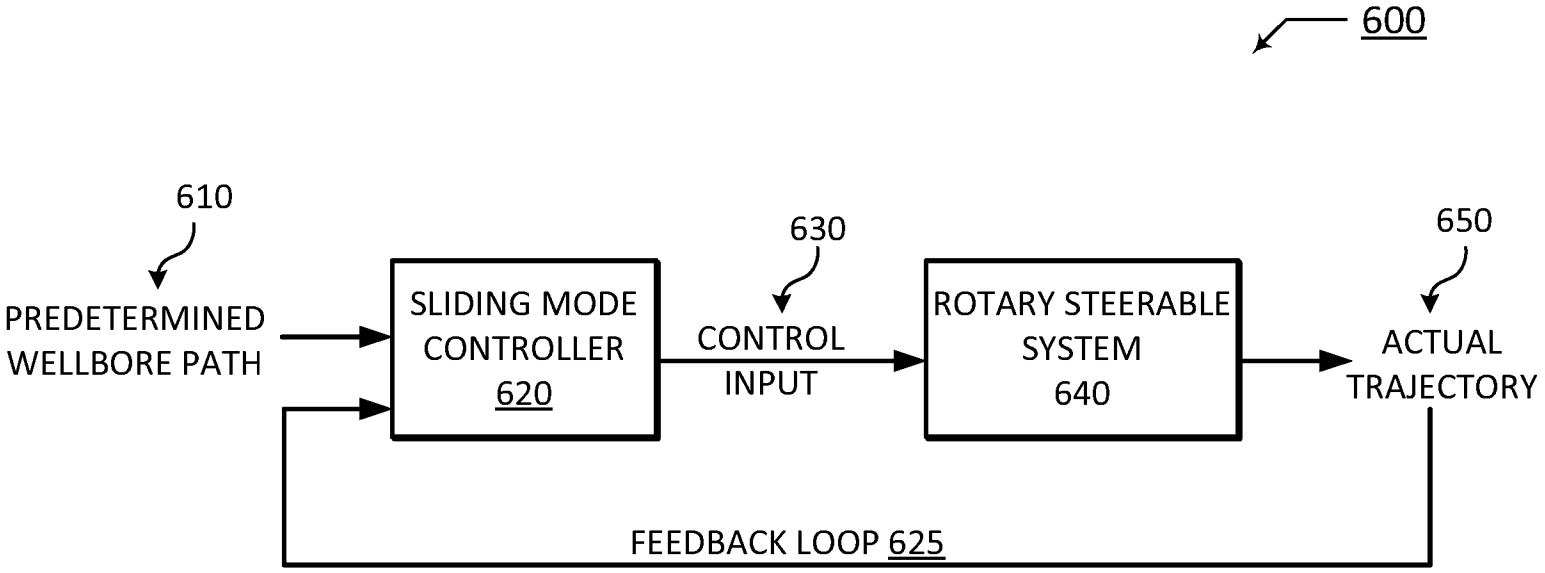
FIG. 6 is a block diagram illustrating a single control loop system, in accordance with the disclosure herein.

For example, FIG. 6 is a block diagram one embodiment of a sliding mode control system 600, which employs sliding mode control logic to steer a drilling tool along a curved wellbore path. Sliding mode control system 600 represents drilling tool components and communication signals for controlling and steering a drilling tool. In particular, sliding mode control system 600 includes a sliding mode controller 620 and a rotary steerable system 640, which collectively operate to monitor and adjust a current trajectory of a drilling tool to minimize trajectory errors (with respect to a reference trajectory). Notably, sliding mode controller 620 and rotary steerable system 640 may represent individual components in a larger control system, such as controller 152, discussed above.

Generally, sliding mode controller 620 provides a control input 630 to rotary steerable system 640, which causes rotary steerable system 640 to apply a force for flexing/bending a drilling shaft, adjust radial movement of pads on the drilling tool, and the like, thereby controlling a current or actual trajectory 650 of the drilling tool.

In detail, sliding mode controller 620 receives a predetermined wellbore path 610 and information regarding an actual trajectory 650 of the drilling tool (e.g., from feedback loop 625). Predetermined wellbore path 610 can be communicated to sliding mode controller 620 from any number of the components, hardware, and/or software illustrated, for example, by the directional drilling environment shown in FIG. 1. Predetermined wellbore path 610, as discussed, represents an intended drilling path for the drilling tool and is typically defined by a collection or waypoints, which correspond to positions in 3D space. These waypoints can be stationary, or can represent a dynamically moving target waypoint that continuously tracks along predetermined wellbore path 610.

Sliding mode controller 620 continuously and iteratively measures and/or estimates (e.g., if actual measurement is not possible/impractical, etc.) a plurality of variables as the drilling tool bores its wellbore path. For example, sliding mode controller 620 can measure an inclination, an azimuth, and a drilled depth. Based on these measurements (and the information regarding an actual trajectory 650), sliding mode controller determines a current trajectory, compares the current trajectory predetermined wellbore path 610, identifies trajectory errors, and determines appropriate control adjustments, which are represented by a control input signal 630. The iterative and continuous operations by sliding mode controller 620 results in a continuously changing control input signal 630 corresponding to a continuously converging (or substantially converging) curved path between actual trajectory 650 and predetermined wellbore path 610. Sliding mode controller 620 transmits control input signal 630 to rotary steerable system 640 for course correction, which cause rotary steerable system 640 to adjust the current or actual trajectory 650 of the drilling tool, as discussed above.

The control input signal and a curvature for the continuously converging curved path can be represented by two-dimensional (2D) coordinates or three-dimensional (3D) coordinates using corresponding Cartesian coordinates. For example, the curvature value for the continuously converging curved path can be defined in 2D coordinates in terms of x, y, as follows:

$$\kappa(s) = \frac{x'(s)y''(s) - y'(s)x''(s)}{(x'^2 + y'^2)^{3/2}} \tag{9}$$

Where second derivatives of x(s) and y(s) can be calculated based on sliding mode control logic, discussed herein.

For 3D coordinates, x, y and z, the current position of the drilling tool is defined by γ=(x, y, z), as follows:

$$\kappa = \frac{\sqrt{(x'y'' - y'x'')^2 + (z'x'' - x'z'')^2 + (y'z'' - z'y'')^2}}{[(x')^2 + (y')^2 + (z')^2]^{3/2}} \tag{10}$$

Where x', y'', y', x'', z', z'' are calculated based on the current position and attitude of the drilling tool as well as the desired or target waypoints on predetermined wellbore path 610 (position, attitude, and/or higher order derivatives, etc.).

Generally, a normal direction in 3D space is used for determining a direction for generating the curvature value. For example, the normal direction for applying the curvature is given by the following vector as shown in Equation 11:

$$\begin{bmatrix} x''y'^2 - x'y'y'' + z'(x''z' - x'z) \\ x'^2y'' - x'x''y' + z'(y''z' - y'z'') \\ x'^2z'' - x'x''z' + y'(y'z'' - y''z') \end{bmatrix} \tag{11}$$

Notably, both the normal direction and the curvature value can be used as part of control input signal 630, which instructs rotary steerable system 640 to steer the drilling tool.

As mentioned, sliding mode controller 620 identifies trajectory errors by comparing, in part, the current trajectory to a reference trajectory of the predetermined wellbore path. These trajectory errors may be represented by one or more error dynamics, which can include position based errors, attitude based errors, derivatives thereof, and the like. Further, the error dynamics may be interpreted in a multi-dimensional error domain, where each axis or dimension corresponds to an error dynamic (for example, a first dimension that corresponds to a position based error and a second dimension that corresponds to an attitude based error, and so on).

Figure 7:
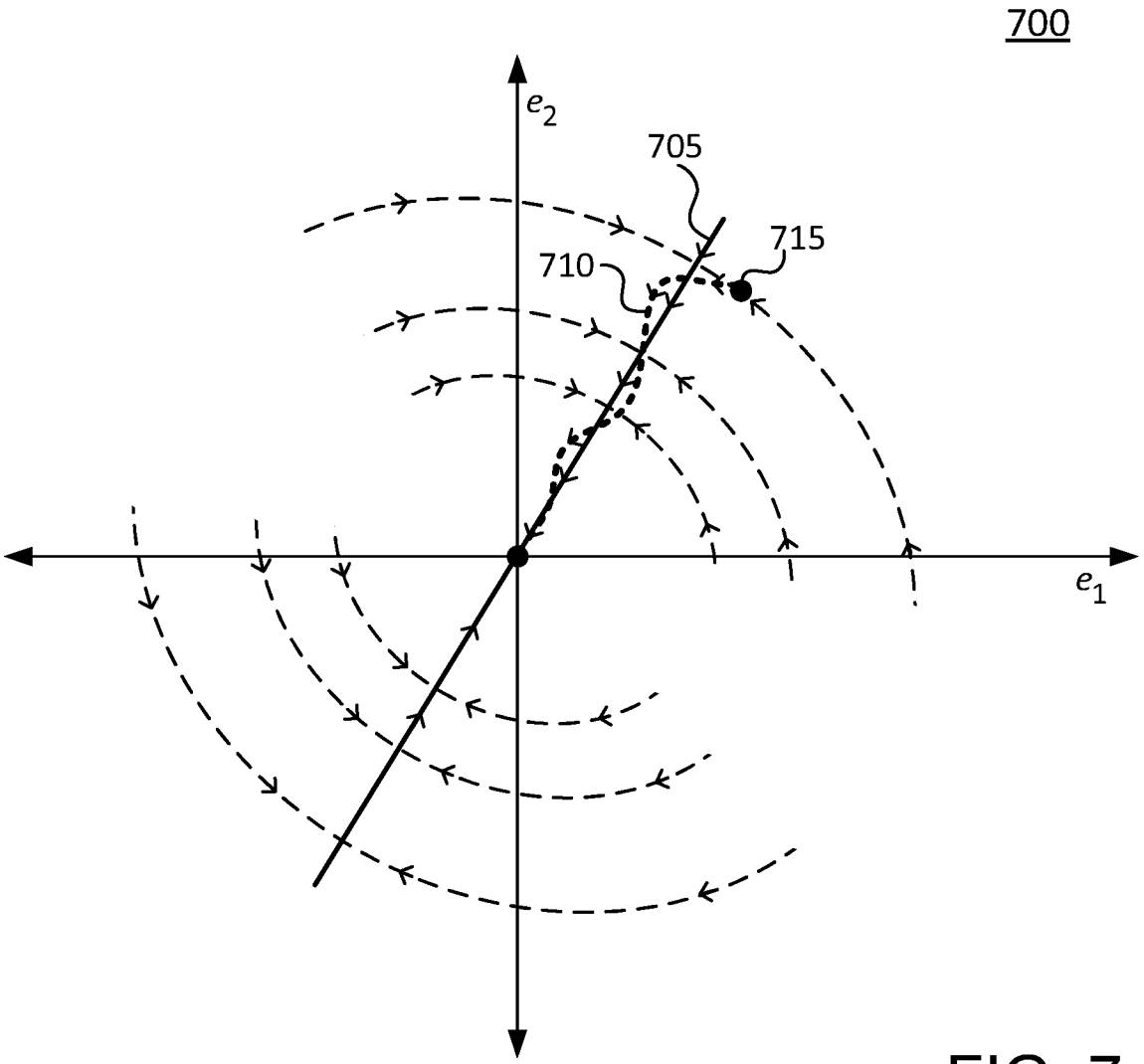
FIG. 7 illustrates a multi-dimensional error domain, in accordance with the disclosure herein.

For example, FIG. 7 illustrates a multi-dimensional error domain 700, showing two dimensions of error represented by axis $e_1$ and axis $e_2$, where an origin coordinate [0, 0] represents 0 error. Multi-dimensional error domain 700 also includes a sliding hypersurface 705, represented by a curve (or a straight line in 2D) in the error dimensions along axis $e_1$ and axis $e_2$ and passing through the origin coordinate, and an error trajectory 710 (e(s)), which originates at an initial state (corresponding to coordinate 715) substantially conforms to sliding hypersurface 705 (σ(s)) as it approaches the origin coordinate. For any given error state of the drilling tool, a sliding mode controller (e.g., sliding mode controller 620) calculates a sliding mode vector that originates from a current error position (e.g., a position along axis $e_1$ and axis $e_2$) and substantially conforms to sliding hypersurface 705. This sliding mode control vector may be continuously calculated as part of a feedback control input (e.g., feedback loop 625), which continuously drives each given error state toward the origin [0, 0] along sliding hypersurface 705 thereby reducing errors in each respective dimension.

With respect to trajectory error, Equation 12 can represent an error dynamic corresponding to the current trajectory error.

$$\frac{\partial e(s)}{\partial s} = f(e(s), s) + B(e(s), s)u(s) \tag{12}$$

Where s is defined as a path length coordinate (e.g., a curvilinear coordinate defined along the predetermined wellbore path).

An error $e(s)=x(s)-r(s)\in\mathbb{R}^n$ is defined as a difference between a current trajectory, x(s), and a reference trajectory, r(s). Notably, the trajectory vector x(s) may include first, second, and higher order derivatives of the trajectory.

A sliding mode vector for these error dynamics can be defined as $u(s)\in\mathbb{R}^m$. For example, $f(e(s), s)\in\mathbb{R}^n$ can define a vector that is either a linear or a nonlinear function of e(s), u(s), and $B(e(s), s)\in\mathbb{R}^{n\times m}$. The reference trajectory r(s) can be provided to sliding mode controller 620 as part of predetermined wellbore path 610, which can include one waypoint, several distinct waypoints, or a continuous path.

Sliding mode controller 620 typically employs sliding mode control logic that increases path tracking performance for the rotary steerable system, as discussed below. For example, sliding mode controller 620 can determine an n-m dimensional sliding hypersurface σ(e(s), s)=0 (e.g., sliding hypersurface 705), such that the current trajectory error for a given state, when confined to the n-m dimensional sliding hypersurface (as described above), exhibits an intended behavior—e.g., drives toward origin [0,0]. Sliding mode controller 620 further determines a sliding mode vector u(s) having a trajectory that intersects and remains in line or with substantially conforms to the n-m dimensional sliding hypersurface.

In one example, the sliding mode vector is selected as a superposition (e.g., a summation) of a corrective control $u_{cor}(s)$ and an equivalent control $u_{eq}(s)$, as provided by Equation 13, below.

$$u(s)=u_{cor}(s)+u_{eq}(s) \tag{13}$$

Where the corrective control $u_{cor}(s)$ compensates for deviation from the sliding surface, and the equivalent control $u_{eq}(s)$ brings the derivative of the sliding surface to zero.

For example, still referring again to FIG. 7, multi-dimensional error domain 700 also illustrates isolated effects of $u_{cor}(s)$ and $u_{eq}(s)$. As discussed, error trajectory 710 (e(s)) begins at an initial state corresponding to coordinate 715. A sliding mode controller (e.g., sliding mode controller 620), determines the initial state at coordinate 715 and determines corrective vectors ($u_{cor}(s)$) and equivalent vectors ($u_{eq}(s)$) to drive the state (error trajectory 710) on a path that intersects and follows sliding hypersurface 705 ($\sigma(s)$) toward origin [0, 0].

$U_{cor}(s)$ is shown by portions of concentric circles, each intersect sliding hypersurface 705. The corrective vector corresponding to $u_{cor}(s)$ at the initial state (coordinate 715) drives error trajectory 710 along the respective concentric circle to intersect sliding hypersurface 705. For each subsequent state, the sliding mode controller determines a new corrective vector corresponding to $u_{cor}(s)$ and drives the subsequent state to intersect sliding hypersurface 705.

$U_{eq}(s)$ is shown as a straight line overlaid over sliding hypersurface 705 (with arrows pointing toward the origin [0, 0]. The equivalent vector corresponding to $u_{eq}(s)$ drives the state (error trajectory 710) on a path that conforms to or follows sliding hypersurface 705 toward the origin [0, 0]. Put differently, for any given state, the equivalent vector is product of a derivative function of the sliding hypersurface and confines state movements tangent to the sliding hypersurface 705.

Error trajectory 710 (e(s)) moves according to a superposition or a summation of the corrective and equivalent vectors corresponding to $u_{cor}(s)$ and $u_{eq}(s)$, respectively, on a curving path toward and along sliding hypersurface 705 and thus, toward the origin (e.g., a 0 error state).

In operation, the corrective control $u_{cor}(s)$ drives the state to intersect with the n-m dimensional sliding surface, and the equivalent control $u_{eq}(s)$ governs state movement tangent to the n-m dimensional sliding surface and maintains or confines the state on the n-m dimensional sliding surface. For example, movement tangent to the n-m dimensional sliding hypersurface is shown in Equation 14, below.

$$\frac{\partial\sigma(e(s),s)}{\partial s} = \frac{2\sigma(e(s),s)}{\partial e(s)}\frac{\partial e(s)}{\partial s} = 0 \tag{14}$$

And the equivalent control can be defined by Equation 15, as follows:

$$u_{eq}(s) = -\left[\frac{\partial\sigma(e(s),s)}{\partial e(s)}B(e(s),s)\right]^{-1}\frac{\partial\sigma(e(s),s)}{\partial e(s)}f(e(s),s) \tag{15}$$

A corrective control is selected such that u(s) satisfies the conditions expressed in Equation 16.

$$\sigma^T(e(s),s)\frac{\partial\sigma(e(s),s)}{\partial s} = \sigma^T(x(s),s)\frac{\partial\sigma(x(s),s)}{\partial x}[f(e(s),s)+B(e(s),s)u(s)] < 0 \tag{16}$$

In at least one example, $u_{cor}(s)$ can be set as Equation 17A, $$u_{cor}(s) = -a(e(s),s)\mathrm{sgn}(\sigma(e(s),s)) \tag{17A}$$

where $a(e(s), s) \in \mathbb{R}^{m\times m}$ is a function of the trajectory error, and $\mathrm{sgn}(\sigma(e(s), s))$ is a signum function.

In an alternative example, $u_{cor}(s)$ can be set as Equation 17B, $$u_{cor}(s) = -a(e(s),s)\mathrm{sat}(\sigma(e(s),s)) \tag{17B}$$

where $\mathrm{sat}(\sigma(e(s), s))$ is a saturation function.

Figure 8:
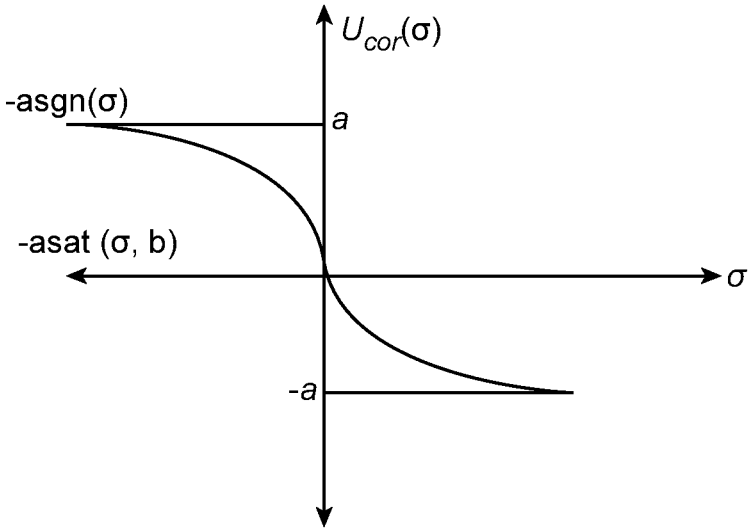
FIG. 8 is an exemplary graph illustrating correctional control, in accordance with the disclosure herein.

FIG. 8 illustrates an exemplary graph of a corrective control candidates for a constant a. A curvature value is calculated as a function of a resulting sliding mode vector $u(s)=u_{cor}(s)+u_{eq}(s)$ in combination with an actual trajectory x(s) of the directional drilling tool and a reference trajectory r(s) as shown in Equation 18.

$$u_{RSS}(s) = f(x(s),r(s),u(s),s) \tag{18}$$

Figure 9:
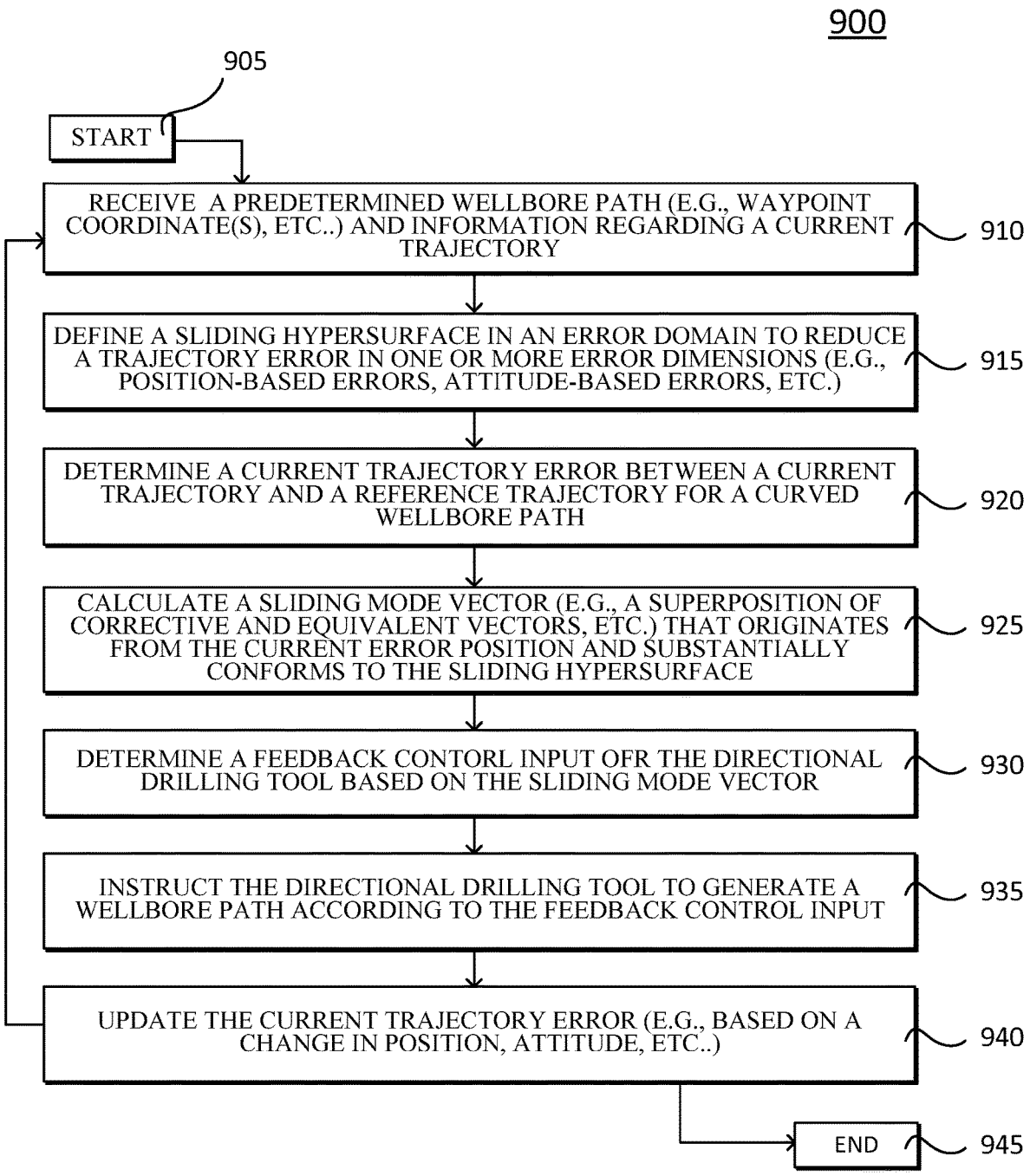
FIG. 9 is a flow chart illustrating a sliding control feedback flow diagram procedure, in accordance with the disclosure herein.

FIG. 9 illustrates a sliding control feedback procedure 900 for adjusting the trajectory of a directional drilling tool using a sliding mode controller (e.g., sliding mode controller 620). Procedure 900 begins at step 905 and continues to step 910 where, as discussed above, the sliding mode controller receives a predetermined wellbore path (e.g., waypoint or target coordinate(s), etc.) as well as information regarding a current trajectory for the drilling tool. As discussed, this information can include measurements by sensors regarding inclination, azimuth, drilled depth, as well as feedback information from a rotary steerable system (e.g., rotary steerable system 640).

Procedure 900 continues on to step 915 where the sliding mode controller defines a sliding hypersurface in an error domain (e.g., with one or more error axes such as $e_1$, $e_2$, and the like). The sliding hypersurface operatively reduces trajectory errors such as position-based errors, attitude-based errors, and the like, and in one or more error dimensions, where an origin coordinate position [0,0,0,[ . . . ]] represents zero error. The sliding mode controller further determines, at step 920, a current trajectory error between a current trajectory and a reference trajectory for a curved wellbore path. Generally, the curved wellbore path represents the predetermined wellbore path where the reference trajectory can include one or more waypoints on the predetermined wellbore path.

The sliding mode controller further analyzes the current trajectory error in context of the one or more error axis in the error domain, and calculates, at step 925, a sliding mode vector that originates from the current error position and substantially conforms to the sliding hypersurface (e.g., in one or more error dimensions). For example, as discussed above, the sliding mode vector can be a superposition or summation of a corrective vector ($u_{cor}(s)$) and an equivalent vector ($u_{eq}(s)$). The sliding mode vector operatively drives the current error state on a path that intersects and follows the sliding hypersurface toward the origin [0, 0, 0, [ . . . ]].

Based on the sliding mode vector, the sliding mode controller determines (step 930) a feedback control input for the directional drilling tool, which may be further communicated by the sliding mode controller to a rotary steerable system to instruct the rotary steerable system to generate a wellbore path. The sliding mode controller continuously updates its current trajectory error in step 940 (e.g., based on changes in position, attitude, etc.). Procedure 900 may subsequently end at step 945, or it may continue on again to step 910 (according to a feedback loop) and iteratively repeat steps 910 through steps 940.

Certain steps within procedure 900 may be optional, and further, the steps shown in FIG. 9 are merely examples for illustration—certain other steps may be included or excluded as desired. Further, while a particular order of the steps is shown, this ordering is merely illustrative, and any suitable arrangement of the steps may be utilized without departing from the scope of the embodiments herein.

The following example is provided to illustrate the subject matter of the present disclosure. The example is not intended to limit the scope of the present disclosure and should not be so interpreted.

Example

As discussed above, the sliding mode techniques disclosed herein may be employed by a sliding mode controller communicatively coupled to a rotary steerable system in a directional drilling tool. Operatively, the sliding mode controller tracks a current trajectory of the drilling tool in a 2-D (x, y) plane. The current trajectory includes position and attitude values and can be represented by state vectors such as $x(s)=[x(s), x'(s)]^T$ and $(s)=[y(s), y'(s)]^T$. A predetermined wellbore path, defined by one or more waypoints, can be provided to the sliding mode controller. The sliding mode controller can determine a reference trajectory, which includes one or more waypoints on the predetermined wellbore path, as a continuous path in the form of Equations 19A and 19B, as shown below.

$$r_x(s)=[r_x(s),r_x'(s)]^T \tag{19A}$$

$$r_y(s)=[r_y(s),r_y'(s)]^T \tag{19B}$$

Thus, $(r_x(t), r_y(t))$ can be considered as a reference position, whereas $(r_x'(t), r_y'(t))$ is an indicator of the reference attitude in (x, y) plane. With the selection of the state space matrices as $$A=\begin{bmatrix}1 & 0\\ 0 & 0\end{bmatrix}, B=\begin{bmatrix}0\\ 1\end{bmatrix}$$

the error dynamics can be defined as shown in Equations 20A and 20B, $$e_x'(s)=Ae_x(s)+Bu_x(s) \tag{20A}$$

$$e_y'(s)=Ae_y(s)+Bu_y(s) \tag{20B}$$

where $e_x(s)=x(s)-r_x(s)$. Sliding surfaces for each error dynamics can be set as defined in Equation 21, $$\begin{matrix}\sigma_x(e_x(s), s)=\Sigma^T e_x(s)=0\\ \sigma_y(e_y(s), s)=\Sigma^T e_y(s)=0\end{matrix}, \Sigma=\begin{bmatrix}\sigma_1\\ \sigma_2\end{bmatrix} \tag{21}$$

where $\sigma_1$ and $\sigma_2$ are constants, resulting in an sliding mode vector as shown in Equations 22A and 22B, below.

$$u_x(s)=u_{x_{eq}}(s)+u_{x_{cor}}(s)=-(\Sigma^T B)^{-1}\Sigma^T Ae_x(s)-a\mathrm{sat}(\sigma_x,b) \tag{22A}$$

$$u_y(s)=u_{y_{eq}}(s)+u_{y_{cor}}(s)=-(\Sigma^T B)^{-1}\Sigma^T Ae_y(s)-a\mathrm{sat}(\sigma_y,b) \tag{22B}$$

A saturation function can be used to further define the progression of the curve. The saturation function can then be set as Equation 23.

$$sat(\sigma, b)=\frac{a\tan(b\sigma)-a\tan(b\sigma)}{\pi} \tag{23}$$

A desired curvature, κ(s), for a corrective trajectory or path can be fed back to the rotary steerable system as a force or bending control to drive the directional drilling tool substantially towards and along the predetermined wellbore path. Thus, the sliding mode input to the directional drilling tool is defined by Equation 24.

$$u_{RSS}(s)=\kappa(s)=\frac{x'(s)y''(s)-y'(s)x''(s)}{[(x'(s))^2+(y'(t))^2]^{3/2}} \tag{24}$$

The variables x"(s) and y"(s) can be defined as follows, $x''(s)=r_x''(s)+e_x''(s)=r_x''(s)+u_x(s)$ and $y''(s)=r_y''(s)+e_y''(s)=r_y''(s)+u_y(s)$. Therefore, the sliding mode input to the rotary steerable system can be rewritten as Equation 25, below.

$$u_{RSS}(s)=\kappa(s)=\frac{x'(s)(r_y''(s))-y'(s)(r_x''(s)+u_x(s))}{[(x'(s))^2+(y'(s))^2]^{3/2}} \tag{25}$$

Figure 10:
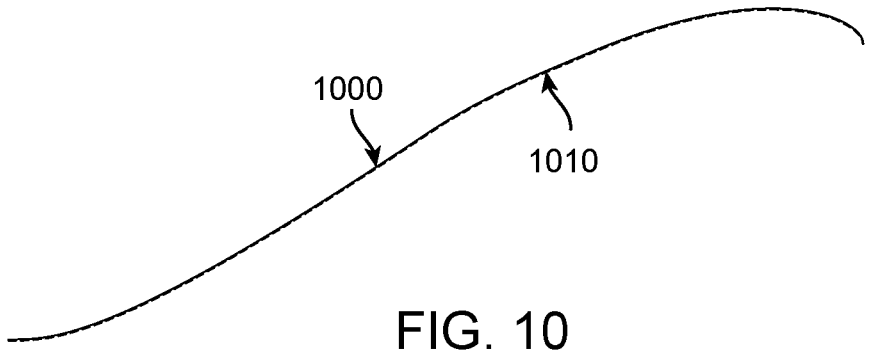
FIG. 10 is an exemplary graph illustrating convergence of a predetermined and actual drilling trajectory, in accordance with the disclosure herein.

FIG. 10 illustrates an exemplary trajectory graph having a reference path shown as solid line 1000. Dotted line 1010 represents the actual trajectory of a directional drilling tool wherein the sliding mode controller continuously feeds back proper control signals to substantial convergence.

Figure 11:
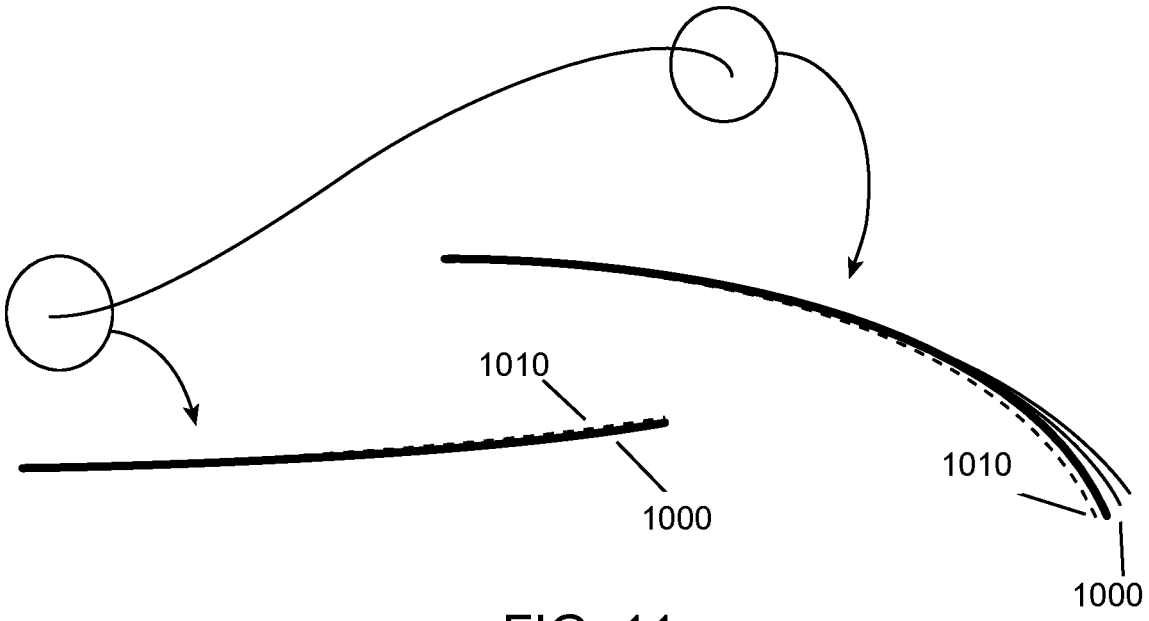
FIG. 11 is an illustration of a test result of a sliding mode controller, in accordance with the disclosure herein.

After the constraints of the sliding hypersurface are determined, the strength of the sliding hypersurface can be tested. Using the reference path 1000 as shown in FIG. 10, 30 simulations were conducted to test the sliding hypersurface. A disturbance was added to the data fed back to the sliding mode controller having a desired curvature as κ(s)+Δκ(s). The Δκ(s) was allowed to randomly vary between [−κ(s), +κ(s)], corresponding to a 100% disturbance in the control command. Such Δκ(s) can be the result of a variety of causes including, but not limited to, inaccuracy of the curvature generation control of the tool, inaccuracy in the state measurements, and inaccuracy of estimations. The results of the simulations are shown in FIG. 11, with the dotted line 1010 being the actual trajectory, and solid lines 1000 of differing thickness being reference paths, illustrating that simultaneous convergence to a desired position and attitude can be achieved via the sliding mode control scheme even when there are disturbances in the drilling process or uncertainties in the data.

While there have been shown and described illustrative embodiments for sliding mode control techniques that provide simultaneous convergence for positions and attitudes between an actual wellbore path and a planned well path, it is to be understood that various other adaptations and modifications may be made within the spirit and scope of the embodiments herein. For example, the embodiments have been shown and described herein with respect to a rotary steerable system and specific components. However, the embodiments in their broader sense are not as limited, and may, in fact, be used with any type of directional drilling tool. In addition, the embodiments are shown with certain devices/modules performing certain operations however, it is appreciated that various other sensors/devices may be readily modified to perform operations without departing from the spirit and scope of this disclosure.

The foregoing description has been directed to specific embodiments. It will be apparent, however, that other variations and modifications may be made to the described embodiments, with the attainment of some or all of their advantages. For instance, it is expressly contemplated that the components and/or elements described herein can be implemented as software being stored on a tangible (non-transitory) computer-readable medium, devices, and memories (e.g., disks/CDs/RAM/EEPROM/etc.) having program instructions executing on a computer, hardware, firmware, or a combination thereof. Further, methods describing the various functions and techniques described herein can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on. In addition, devices implementing methods according to these disclosures can comprise hardware, firmware and/or software, and can take any of a variety of form factors. Typical examples of such form factors include laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example. Instructions, media for conveying such instructions, computing resources for executing them, and other structures for supporting such computing resources are means for providing the functions described in these disclosures. Accordingly this description is to be taken only by way of example and not to otherwise limit the scope of the embodiments herein. Therefore, it is the object of the appended claims to cover all such variations and modifications as come within the true spirit and scope of the embodiments herein.

Statements of the Disclosure Include:

Statement 1: A method including: defining, by a sliding mode controller, a sliding hypersurface for reducing a trajectory error in one or more error dimensions, the one or more error dimensions includes at least a first dimension that corresponds to a position based error and a second dimension that corresponds to an attitude based error; determining, by the sliding mode controller, a current trajectory error between a current trajectory of a directional drilling tool and a reference trajectory for a curved path, the current trajectory error corresponds to a current error position in the one or more error dimensions; calculating, by the sliding mode controller, a sliding mode vector that originates from the current error position and substantially conforms to the sliding hypersurface in the one or more error dimensions; determining, by the sliding mode controller, a feedback control input for the directional drilling tool based on the sliding mode vector; instructing, by the sliding mode controller, the directional drilling tool to generate a wellbore path according to the feedback control input; and updating the current trajectory error based on at least one of a change in position or a change in attitude for the directional drilling tool.

Statement 2: The method according to Statement 1, wherein calculating the sliding mode vector further includes: calculating, by the sliding mode controller, a corrective vector that originates from the error position and intersects the sliding hypersurface; calculating, by the sliding mode controller, an equivalent vector as a derivative function of the sliding hypersurface to substantially confine the sliding mode vector to the sliding hypersurface; and determining, by the sliding mode controller, the sliding mode vector based on a superposition of the corrective vector and the equivalent vector.

Statement 3: The method according to any one of Statements 1-2: further including determining, by the sliding mode controller, the sliding hypersurface based on at least one of a signum function or a saturation function.

Statement 4: The method according to any one of Statements 1-3: further including tracking, by the sliding mode controller, the current trajectory of the directional drilling tool based on an inclination, an azimuth, and a depth.

Statement 5: The method according to any one of Statements 1-4, wherein instructing the directional drilling tool to generate the wellbore path further includes: providing the feedback control input to a force or a bending controller of the directional drilling tool and radially moving one or more pads on the directional drilling tool or changing an eccentricity of a drill shaft of the directional drilling tool based on the feedback control input.

Statement 6: The method according to any one of Statements 1-5, wherein the curved path includes at least one position substantially proximate to a predetermined wellbore path.

Statement 7: The method according to any one of Statements 1-6, wherein the at least one position includes a waypoint in the vicinity of the predetermined wellbore path.

Statement 8: A system including: a directional drilling tool disposed in the wellbore and having a plurality of computing devices; one or more processors, communicatively coupled with the computing devices, and having a memory having stored therein instructions which, when executed, cause the one or more processors to: define, by a sliding mode controller, a sliding hypersurface for reducing a trajectory error in one or more error dimensions, the one or more error dimensions includes at least a first dimension that corresponds to a position based error and a second dimension that corresponds to an attitude based error; determine, by the slide mode controller, a current trajectory error between a current trajectory of the directional drilling tool and a reference trajectory for a curved path, the current trajectory error corresponds to a current error position in the one or more error dimensions; calculate, by the sliding mode controller, a sliding mode vector that originates from the current error position and substantially conforms to the sliding hypersurface in the one or more error dimensions; determine, by the sliding mode controller, a feedback control input for the directional drilling tool based on the sliding mode vector; instruct, by the sliding mode controller, the directional drilling tool to generate a wellbore path according to the feedback control input; and update the current trajectory error based on at least one of a change in position or a change in attitude for the directional drilling tool.

Statement 9: The system according to Statement 8, wherein the sliding mode vector is calculated by: calculating, by the sliding mode controller, a corrective vector that originates from the error position and intersects the sliding hypersurface; calculating, by the sliding mode controller, an equivalent vector as a derivative function of the sliding hypersurface to substantially confine the sliding mode vector to the sliding hypersurface; determining, by the sliding mode controller, the sliding mode vector based on a superposition of the corrective vector and the equivalent vector.

Statement 10: The system according to any one of Statements 8-9, the instructions further cause the processor to: determine, by the sliding mode controller, the sliding hypersurface based on at least one of a signum function or a saturation function.

Statement 11: The system according to any one of Statements 8-10, wherein the instructions further cause the processor to: track, by the sliding mode controller, the current trajectory of the directional drilling tool based on an inclination, an azimuth, and a depth.

Statement 12: The system according to any one of Statements 8-11, wherein the generation of the wellbore path further comprises: providing the feedback control input to a force to a force or a bending controller of the directional drilling tool and radially moving one or more pads on the directional drilling tool or changing an eccentricity of a drill shaft of the directional drilling tool based on the feedback control input.

Statement 13: The system according to any one of Statements 8-12, wherein the curved path includes at least one position substantially proximate to a predetermined wellbore path.

Statement 14: The system according to any one of Statements 8-13, wherein the at least one position includes a waypoint in the vicinity of the predetermined wellbore path.

Statement 15: A non-transitory computer-readable storage medium having instructions stored thereon which, when executed by one or more processors, cause the one or more processors to: define, by a sliding mode controller, a sliding hypersurface for reducing a trajectory error in one or more error dimensions, the one or more error dimensions includes at least a first dimension that corresponds to a position based error and a second dimension that corresponds to an attitude based error; determine, by the slide mode controller, a current trajectory error between a current trajectory of a directional drilling tool and a reference trajectory for a curved path, the current trajectory error corresponds to a current error position in the one or more error dimensions; calculate, by the sliding mode controller, a sliding mode vector that originates from the current error position and substantially conforms to the sliding hypersurface in the one or more error dimensions; determine, by the sliding mode controller, a feedback control input for the directional drilling tool based on the sliding mode vector; instruct, by the sliding mode controller, the directional drilling tool to generate a wellbore path according to the feedback control input; and update the current trajectory error based on at least one of a change in position or a change in attitude for the directional drilling tool.

Statement 16: The non-transitory computer-readable storage medium according to Statement 15, wherein the calculation of the sliding mode vector further includes: calculating, by the sliding mode controller, a corrective vector that originates from the error position and intersects the sliding hypersurface; calculating, by the sliding mode controller, an equivalent vector as a derivative function of the sliding hypersurface to substantially confine the sliding mode vector to the sliding hypersurface; and determining, by the sliding mode controller, the sliding mode vector based on a superposition of the corrective vector and the equivalent vector.

Statement 17: The non-transitory computer-readable storage medium according to any one of Statements 15-16, wherein the instructions further cause the processor to: determine, by the sliding mode controller, the sliding hypersurface based on at least one of a signum function or a saturation function.

Statement 18: The non-transitory computer-readable storage medium according to any one of Statements 15-17, wherein the instructions further cause the processor to: track, by the sliding mode controller, the current trajectory of the directional drilling tool based on an inclination, an azimuth, and a depth.

Statement 19: The non-transitory computer-readable storage medium according to any one of Statements 15-18, wherein generation of the wellbore path further includes: providing the feedback control input to a force or a bending controller of the directional drilling tool and radially moving one or more pads on the directional drilling tool or changing an eccentricity of a drill shaft of the directional drilling tool based on the feedback control input.

Statement 20: The non-transitory computer-readable storage medium according to any one of Statements 15-19, wherein the curved path includes at least one position substantially proximate to a predetermined wellbore path.

What is claimed is:

1. A method for directional drilling, comprising:

defining, by a sliding mode controller, a sliding hypersurface for reducing a trajectory error in one or more error dimensions, the one or more error dimensions includes at least a first dimension that corresponds to a position based error and a second dimension that corresponds to an attitude based error;

determining, by the sliding mode controller, a current trajectory error between a current trajectory of a directional drilling tool and a reference trajectory for a curved path, the current trajectory error corresponds to a current error position in the one or more error dimensions;

calculating, by the sliding mode controller, a sliding mode vector that originates from the current error position and substantially conforms to the sliding hypersurface in the one or more error dimensions;

determining, by the sliding mode controller, a feedback control input for the directional drilling tool based on the sliding mode vector;

instructing, by the sliding mode controller, the directional drilling tool to generate a wellbore path according to the feedback control input; and updating the current trajectory error based on at least one of a change in position or a change in attitude for the directional drilling tool.

2. The method of claim 1, wherein calculating the sliding mode vector further comprises:

calculating, by the sliding mode controller, a corrective vector that originates from the error position and intersects the sliding hypersurface;

calculating, by the sliding mode controller, an equivalent vector as a derivative function of the sliding hypersurface to substantially confine the sliding mode vector to the sliding hypersurface; and determining, by the sliding mode controller, the sliding mode vector based on a superposition of the corrective vector and the equivalent vector.

3. The method of claim 1, further comprising:

determining, by the sliding mode controller, the sliding hypersurface based on at least one of a signum function or a saturation function.

4. The method of claim 1, further comprising:

tracking, by the sliding mode controller, the current trajectory of the directional drilling tool based on an inclination, an azimuth, and a depth.

5. The method of claim 1, wherein instructing the directional drilling tool to generate the wellbore path further comprises:

providing the feedback control input to a force or a bending controller of the directional drilling tool; and radially moving one or more pads on the directional drilling tool or changing an eccentricity of a drill shaft of the directional drilling tool based on the feedback control input.

6. The method of claim 1, wherein the curved path includes at least one position substantially proximate to a predetermined wellbore path.

7. The method of claim 6, wherein the at least one position includes a waypoint in the vicinity of the predetermined wellbore path.

8. A system comprising:

a directional drilling tool disposed in the wellbore and having a plurality of computing devices;

one or more processors, communicatively coupled with the computing devices, and having a memory having stored therein instructions which, when executed, cause the one or more processors to:

define, by a sliding mode controller, a sliding hypersurface for reducing a trajectory error in one or more error dimensions, the one or more error dimensions includes at least a first dimension that corresponds to a position based error and a second dimension that corresponds to an attitude based error;

determine, by the slide mode controller, a current trajectory error between a current trajectory of the directional drilling tool and a reference trajectory for a curved path, the current trajectory error corresponds to a current error position in the one or more error dimensions;

calculate, by the sliding mode controller, a sliding mode vector that originates from the current error position and substantially conforms to the sliding hypersurface in the one or more error dimensions;

determine, by the sliding mode controller, a feedback control input for the directional drilling tool based on the sliding mode vector;

instruct, by the sliding mode controller, the directional drilling tool to generate a wellbore path according to the feedback control input; and update the current trajectory error based on at least one of a change in position or a change in attitude for the directional drilling tool.

9. The system of claim 8, wherein the sliding mode vector is calculated by:

calculating, by the sliding mode controller, a corrective vector that originates from the error position and intersects the sliding hypersurface;

calculating, by the sliding mode controller, an equivalent vector as a derivative function of the sliding hypersurface to substantially confine the sliding mode vector to the sliding hypersurface;

determining, by the sliding mode controller, the sliding mode vector based on a superposition of the corrective vector and the equivalent vector.

10. The system of claim 8, wherein the instructions further cause the processor to:

determine, by the sliding mode controller, the sliding hypersurface based on at least one of a signum function or a saturation function.

11. The system of claim 8, wherein the instructions further cause the processor to:

track, by the sliding mode controller, the current trajectory of the directional drilling tool based on an inclination, an azimuth, and a depth.

12. The system of claim 8, wherein the generation of the wellbore path further comprises:

providing the feedback control input to a force or a bending controller of the directional drilling tool;

radially moving one or more pads or changing an eccentricity of a drill shaft of the directional drilling tool based on the feedback control input.

13. The system of claim 8, wherein the curved path includes at least one position substantially proximate to a predetermined wellbore path.

14. The system of claim 13, wherein the at least one position includes a waypoint in the vicinity of the predetermined wellbore path.

15. A non-transitory computer-readable storage medium having instructions stored thereon which, when executed by one or more processors, cause the one or more processors to:

define, by a sliding mode controller, a sliding hypersurface for reducing a trajectory error in one or more error dimensions, the one or more error dimensions includes at least a first dimension that corresponds to a position based error and a second dimension that corresponds to an attitude based error;

determine, by the slide mode controller, a current trajectory error between a current trajectory of a directional drilling tool and a reference trajectory for a curved path, the current trajectory error corresponds to a current error position in the one or more error dimensions;

calculate, by the sliding mode controller, a sliding mode vector that originates from the current error position and substantially conforms to the sliding hypersurface in the one or more error dimensions;

determine, by the sliding mode controller, a feedback control input for the directional drilling tool based on the sliding mode vector;

instruct, by the sliding mode controller, the directional drilling tool to generate a wellbore path according to the feedback control input; and update the current trajectory error based on at least one of a change in position or a change in attitude for the directional drilling tool.

16. The non-transitory computer-readable storage medium of claim 15, wherein the calculation of the sliding mode vector further comprises:

calculating, by the sliding mode controller, a corrective vector that originates from the error position and intersects the sliding hypersurface;

calculating, by the sliding mode controller, an equivalent vector as a derivative function of the sliding hypersurface to substantially confine the sliding mode vector to the sliding hypersurface; and determining, by the sliding mode controller, the sliding mode vector based on a superposition of the corrective vector and the equivalent vector.

17. The non-transitory computer-readable storage medium of claim 15, wherein the instructions further cause the processor to:

determine, by the sliding mode controller, the sliding hypersurface based on at least one of a signum function or a saturation function.

18. The non-transitory computer-readable storage medium of claim 15, wherein the instructions further cause the processor to:

track, by the sliding mode controller, the current trajectory of the directional drilling tool based on an inclination, an azimuth, and a depth.

19. The non-transitory computer-readable storage medium of claim 15, wherein generation of the wellbore path further comprises:

providing the feedback control input to a force or a bending controller of the directional drilling tool; and radially moving one or more pads on the directional drilling tool or changing an eccentricity of a drill shaft of the directional drilling tool based on the feedback control input.

20. The non-transitory computer-readable storage medium of claim 15, wherein the curved path includes at least one position substantially proximate to a predetermined wellbore path.

* * * * *